US008905400B2

(12) United States Patent
Umeno et al.

(10) Patent No.: US 8,905,400 B2
(45) Date of Patent: Dec. 9, 2014

(54) SHEET FEEDING DEVICE AND IMAGE PROCESSING APPARATUS

(71) Applicants: Hideyuki Umeno, Sagamihara (JP); Yoshiki Omichi, Toyokawa (JP)

(72) Inventors: Hideyuki Umeno, Sagamihara (JP); Yoshiki Omichi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/849,027

(22) Filed: Mar. 22, 2013

(65) Prior Publication Data

US 2013/0256986 A1 Oct. 3, 2013

(30) Foreign Application Priority Data

Mar. 28, 2012 (JP) ..... 2012-073926

(51) Int. Cl.

| | |
|---|---|
| ***B65H 7/02*** | (2006.01) |
| ***B65H 9/00*** | (2006.01) |
| ***B65H 5/06*** | (2006.01) |
| ***B65H 7/08*** | (2006.01) |
| ***B65H 7/06*** | (2006.01) |
| ***G03G 15/00*** | (2006.01) |

(52) U.S. Cl.

CPC ..... *B65H 7/06* (2013.01); *B65H 2701/1311* (2013.01); *B65H 2553/82* (2013.01); *B65H 9/006* (2013.01); *B65H 2801/06* (2013.01); *B65H 5/062* (2013.01); *B65H 2801/39* (2013.01); *B65H 7/08* (2013.01); *B65H 2513/53* (2013.01); *B65H 2513/512* (2013.01); *B65H 2404/1424* (2013.01); *G03G 15/602* (2013.01)

USPC ..... 271/227; 271/249

(58) Field of Classification Search

USPC ..... 271/227, 248, 249

See application file for complete search history.

(56) References Cited

U.S. PATENT DOCUMENTS

| | | | | |
|---|---|---|---|---|
| 4,685,664 | A * | 8/1987 | Petersdorf | 271/227 |
| 6,059,285 | A | 5/2000 | Suga et al. | |

FOREIGN PATENT DOCUMENTS

| | | | |
|---|---|---|---|
| JP | H-10-329986 | A | 12/1998 |
| JP | H11-020993 | A | 1/1999 |
| JP | 2001-192148 | A | 7/2001 |
| JP | 2003-118890 | A | 4/2003 |
| JP | 2003-128297 | A | 5/2003 |

OTHER PUBLICATIONS

Japanese Notification of Reasons for Refusal dated Apr. 1, 2014 issued in the corresponding Japanese Patent Application No. 2012-073926 and English language translation (4 pages).

* cited by examiner

*Primary Examiner* — Michael McCullough

(74) *Attorney, Agent, or Firm* — Buchanan Ingersoll & Rooney PC

(57) ABSTRACT

A sheet feeding device having: a first conveyance roller pair that feeds a sheet; a second conveyance roller pair that feeds the sheet, the second conveyance roller pair being provided downstream from the first conveyance roller pair in a feed direction in which the sheet is fed; and a third conveyance roller pair that feeds the sheet, the third conveyance roller pair being provided downstream from the second conveyance roller pair in the feed direction, in which, when an edge of the sheet that is located on the downstream side of the feed direction is skewed with respect to a direction perpendicular to the feed direction, the second conveyance roller pair slides in the perpendicular direction with the sheet slacking between the first conveyance roller pair and the second conveyance roller pair.

14 Claims, 14 Drawing Sheets

SHEET FEEDING DEVICE AND IMAGE PROCESSING APPARATUS

This application is based on Japanese Patent Application No. 2012-073926 filed on Mar. 28, 2012, the content of which is incorporated herein by reference.

BACKGROUND OF THE INVENTION

1. Field of the Invention

The present invention relates to feeding devices and image processing apparatuses, more particularly to a feeding device that feeds sheets and an image processing apparatus including the same.

2. Description of Related Art

A known conventional sheet feeding device is described in, for example, Japanese Patent Laid-Open Publication No. 2003-128297. FIGS. 12A and 12B are plan views of the feeding device 500 described in Japanese Patent Laid-Open Publication No. 2003-128297.

The feeding device 500 includes a pre-registration roll pair 502 and a registration roll pair 504, as shown in FIGS. 12A and 12B. The pre-registration roll pair 502 and the registration roll pair 504 are arranged in this order in the direction of feeding documents P, so as to feed documents P.

Incidentally, when a document P is fed to the registration roll pair 504 in a skewed state, as shown in FIG. 12A, the feeding device 500 is capable of correcting the skew of the document P. More specifically, when a document P is fed to the registration roll pair 504 in a skewed state, the pre-registration roll pair 502 is released from restraint, and therefore can slide in a direction perpendicular to the feed direction. Thereafter, the pre-registration roll pair 502 is caused to slide in the perpendicular direction by means of force applied to the leading edge of the document P by the registration roll pair 504, as shown in FIG. 12B. Thus, the skew of the document P is corrected.

However, the feeding device 500 described in Japanese Patent Laid-Open Publication No. 2003-128297 has a problem in that skew of a document P placed lengthwise in the feed direction cannot be corrected. More specifically, roller pairs, such as an unillustrated feed roller pair, are provided upstream from the pre-registration roll pair 502 in the feed direction. When a document P is placed lengthwise in the feed direction, the document P is fed by the registration roll pair 504, the pre-registration roll pair 502, and the feed roller pair. In this case, the document P is positioned between the feed roller pair, which inhibits the pre-registration roll pair 502 from sliding. As a result, the feeding device 500 cannot correct the skew of the document P properly.

SUMMARY OF THE INVENTION

A sheet feeding device according to an embodiment of the present invention includes: a first conveyance roller pair that feeds a sheet; a second conveyance roller pair that feeds the sheet, the second conveyance roller pair being provided downstream from the first conveyance roller pair in a feed direction in which the sheet is fed; and a third conveyance roller pair that feeds the sheet, the third conveyance roller pair being provided downstream from the second conveyance roller pair in the feed direction, in which, when an edge of the sheet that is located on the downstream side of the feed direction is skewed with respect to a direction perpendicular to the feed direction, the second conveyance roller pair slides in the perpendicular direction with the sheet slacking between the first conveyance roller pair and the second conveyance roller pair.

In another embodiment of the present invention, an image processing apparatus includes a sheet feeding device and a control section. The sheet feeding device includes a first conveyance roller pair that feeds a sheet, a second conveyance roller pair that feeds the sheet, the second conveyance roller pair being provided downstream from the first conveyance roller pair in a feed direction in which the sheet is fed, and a third conveyance roller pair that feeds the sheet, the third conveyance roller pair being provided downstream from the second conveyance roller pair in the feed direction. When an edge of the sheet that is located on the downstream side of the feed direction is skewed with respect to a direction perpendicular to the feed direction, the second conveyance roller pair slides in the perpendicular direction with the sheet slacking between the first conveyance roller pair and the second conveyance roller pair. The second conveyance roller pair slides in the perpendicular direction by means of force applied by the sheet. The sheet feeding device further includes a restricting section that restricts sliding of the second conveyance roller pair. When the downstream edge contacts the third conveyance roller pair, the restriction by the restricting section on the second conveyance roller pair is cancelled. The sheet feeding device further includes a first detecting section provided between the second conveyance roller pair and the third conveyance roller pair. The control section cancels the restriction by the restricting section on the second conveyance roller pair once the first detecting section detects the downstream edge.

In another embodiment of the present invention, an image processing apparatus includes a sheet feeding device and a control section. The sheet feeding device includes a first conveyance roller pair that feeds a sheet, a second conveyance roller pair that feeds the sheet, the second conveyance roller pair being provided downstream from the first conveyance roller pair in a feed direction in which the sheet is fed, and a third conveyance roller pair that feeds the sheet, the third conveyance roller pair being provided downstream from the second conveyance roller pair in the feed direction. When an edge of the sheet that is located on the downstream side of the feed direction is skewed with respect to a direction perpendicular to the feed direction, the second conveyance roller pair slides in the perpendicular direction with the sheet slacking between the first conveyance roller pair and the second conveyance roller pair. The sheet feeding device further includes a driving section that slides the second conveyance roller pair, and a second detecting section that detects a skewing direction of the downstream edge. The control section causes the driving section to slide the second conveyance roller pair on the basis of the direction detected by the second detecting section.

DETAILED DESCRIPTION OF THE PREFERRED EMBODIMENTS

Hereinafter, image reading apparatuses that include sheet feeding devices according to embodiments of the present invention will be described along with an image forming apparatus (image processing apparatus).

First Embodiment

Configuration of Sheet Feeding Device

Figure 1:
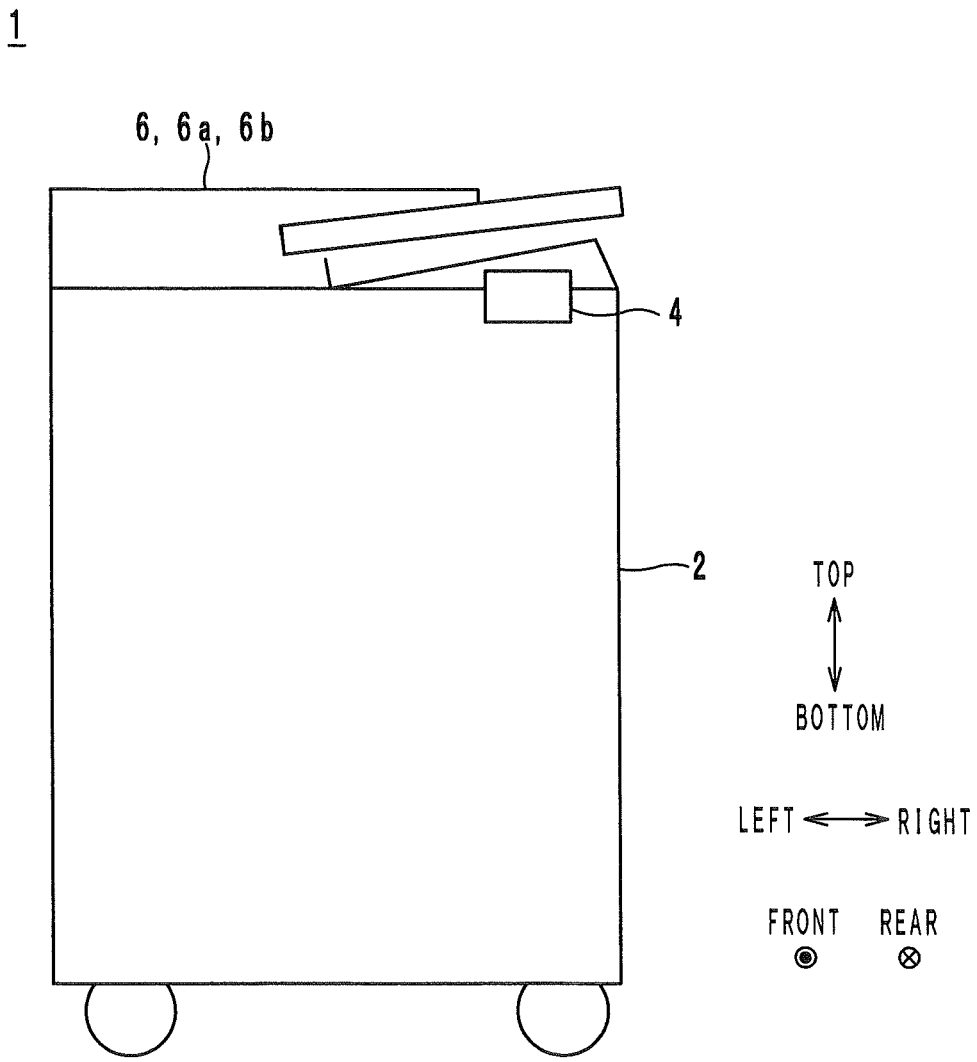
FIG. 1 is a diagram illustrating the overall configuration of an image forming apparatus including an image reading apparatus.
Figure 2:
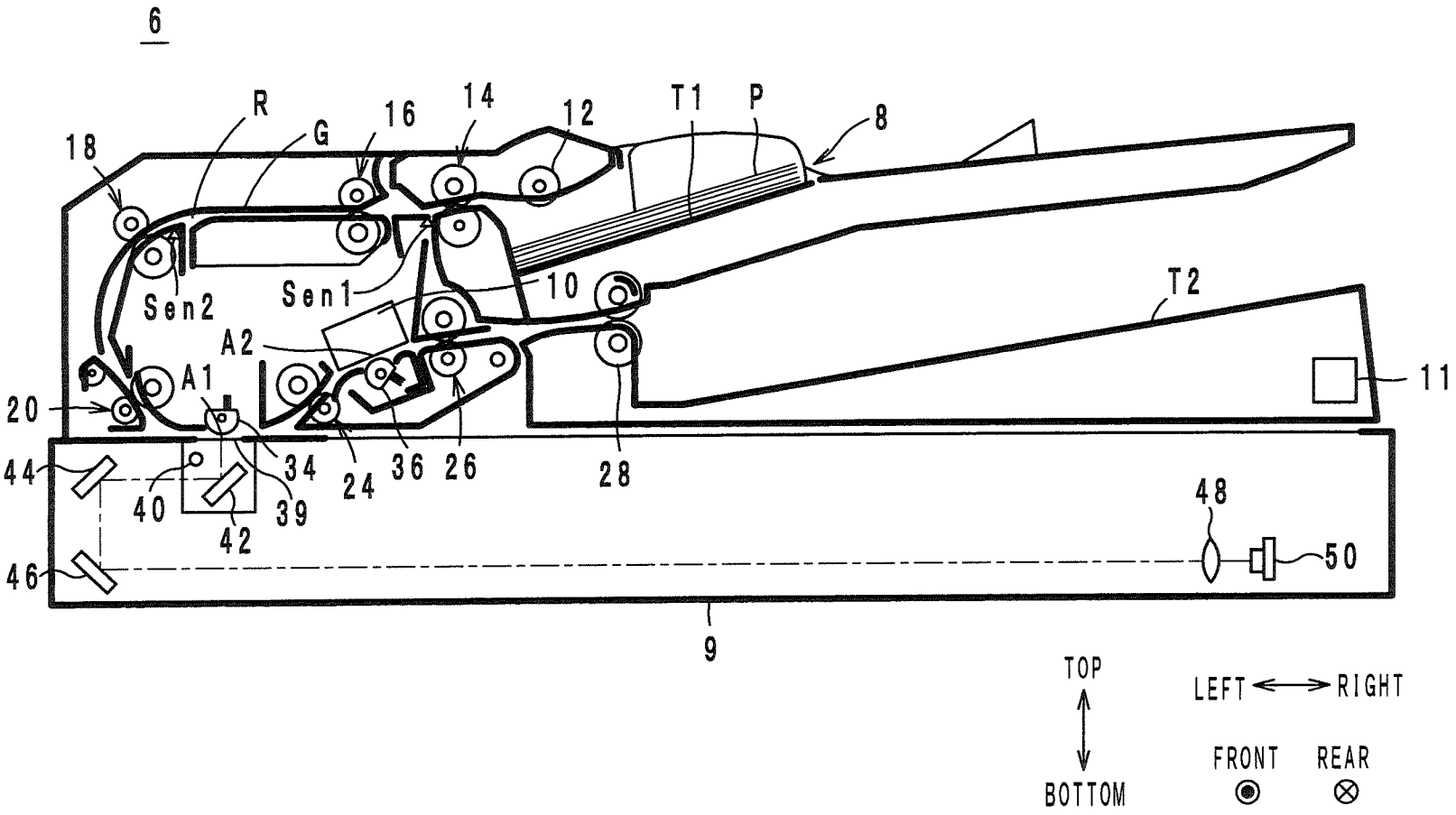
FIG. 2 is a configuration diagram of the image reading apparatus.
Figure 3:
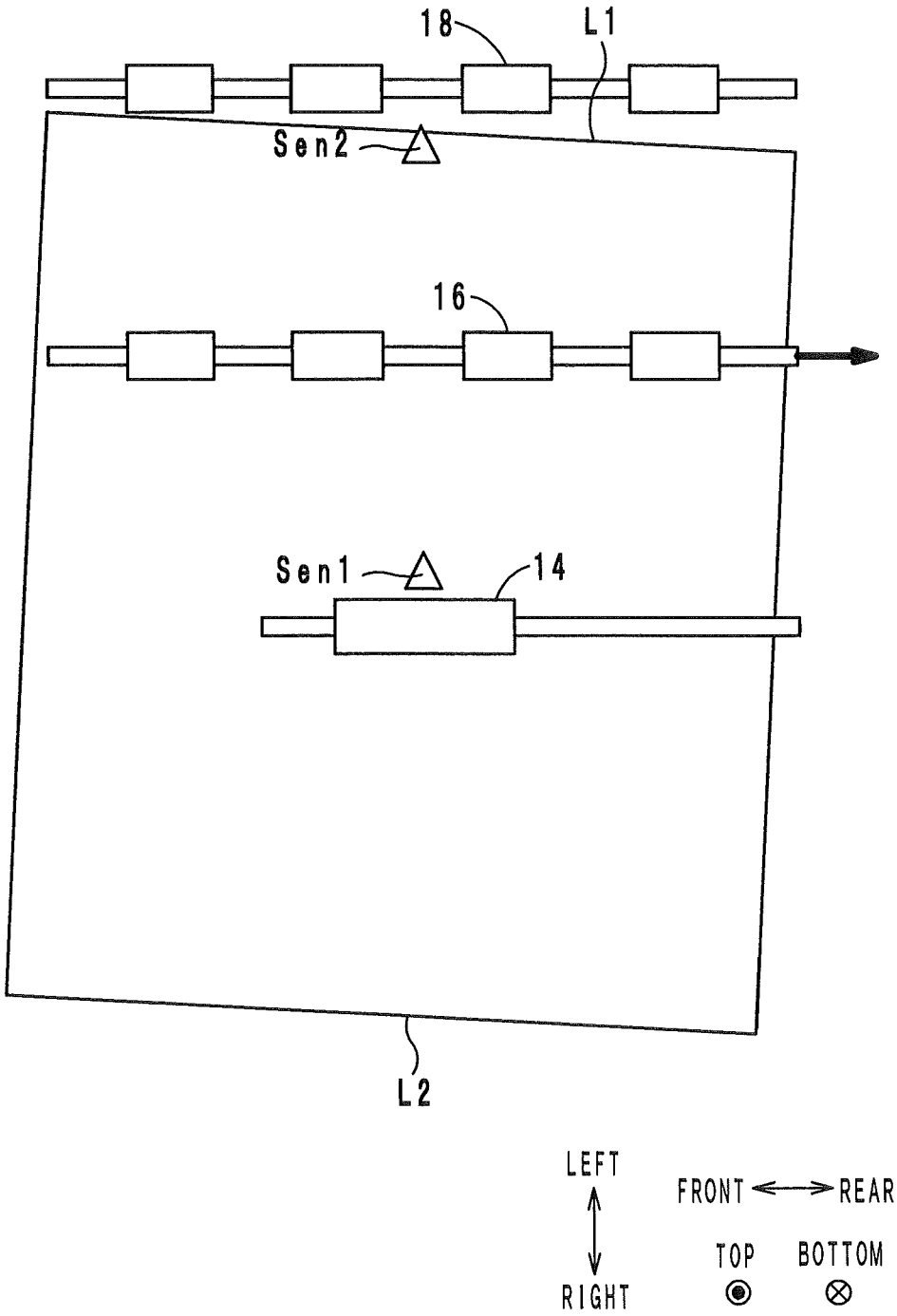
FIG. 3 is a top view of a feed roller pair, conveyance roller pairs, and paper stop roller pairs in the image reading apparatus.

The configuration of a sheet feeding device according to a first embodiment of the present invention will be described below with reference to the drawings. FIG. 1 is a diagram illustrating the overall configuration of an image forming apparatus 1 including an image reading apparatus 6. FIG. 2 is a configuration diagram of the image reading apparatus 6. FIG. 3 is a top view of a feed roller pair 14, conveyance roller pairs 16, and paper stop roller pairs 18 in the image reading apparatus 6. In the following, the right-left direction in FIGS. 1 and 2 will be simply referred to as the right-left direction, the top-bottom direction in FIGS. 1 and 2 will be simply referred to as the top-bottom direction, and the direction perpendicular to each of the sheets of FIGS. 1 and 2 will be referred to as the front-rear direction.

The image forming apparatus 1 includes a printing unit 2, a touch panel 4, and the image reading apparatus 6, as shown in FIG. 1.

The printing unit 2 forms a toner image on a sheet on the basis of image data for a document scanned by the image reading apparatus 6 or externally input image data. The touch panel 4 functions as both a display device and an input device.

The image reading apparatus 6 is an apparatus that scans a document (sheet) passing over platen glass using an automatic document feeder (ADF) mechanism. The image reading apparatus 6 includes a sheet feeding device 8 and reading units 9 and 10, as shown in FIG. 2.

The sheet feeding device 8 includes a control unit 11, a pick-up roller 12, a feed roller pair 14, conveyance roller pairs 16, 20, 24, and 26, paper stop roller pairs 18, an ejection roller pair 28, rollers 34 and 36, guides G, trays T1 and T2, and sensors Sen1 and Sen2, as shown in FIG. 2.

In tray T1, documents P to be scanned are stacked. The left edge of tray T1 can pivot up and down near the center in the left-right direction. Specifically, when no document P is to be picked up from tray T1, the left edge of tray T1 is located at the bottom position, as shown in FIG. 2. On the other hand, when a document P is to be picked up from tray T1, the left edge of tray T1 is raised. In the following, the top principal surface of a document P placed in tray T1 will be referred to as the front, and the bottom principal surface of the document P will be referred to as the back.

The guides G are constituent parts of a feed path R provided in the image reading apparatus 6 to convey documents P. In FIG. 2, only a representative guide is assigned the reference character G. The feed path R has a U-like shape turned 90 degrees clockwise.

The pick-up roller 12 is provided at the upstream end of the feed path R, and takes up documents P stacked in tray T1 one by one to forward them into the feed path R. More specifically, when a document P is to be scanned, the left edge of tray T1 is raised. Accordingly, the pick-up roller 12 contacts the topmost of the documents P stacked in tray T1. The pick-up roller 12 is rotated by an unillustrated power source. As a result, the pick-up roller 12 forwards the document P into the feed path R.

The feed roller pair 14 is made up of a pair of rollers being disposed with the feed path R therebetween, as shown in FIGS. 2 and 3. Each of the sets of conveyance roller pairs 16, 20, 24, and 26 and the set of paper stop roller pairs 18 consists of four pairs of rollers, each pair being disposed with the feed path R therebetween. The feed roller pair 14, the conveyance roller pairs 16, the paper stop roller pairs 18, and the conveyance roller pairs 20, 24, and 26 are arranged in this order in the feed path R to convey documents P along the feed path R. Accordingly, the conveyance roller pairs 16 are positioned downstream from the feed roller pair 14 in the direction of feeding documents P. Moreover, the paper stop roller pairs 18 are positioned downstream from the conveyance roller pairs 16 in the direction of feeding documents P. Note that the feed roller pair 14, the conveyance roller pairs 16, the paper stop roller pairs 18, and the conveyance roller pairs 20, 24, and 26 have unillustrated power sources.

Furthermore, the paper stop roller pairs 18 in a non-rotating state contact the downstream edge of a document P conveyed by the feed roller pair 14 and the conveyance roller pairs 16 in the feed direction (the edge will be simply referred to below as edge L1), as shown in FIG. 3, thereby aligning edge L1 of the document P. Specifically, the paper stop roller pairs 18 perform skew correction on the document P. After the skew correction, the paper stop roller pairs 18 rotate to forward the document P further downstream of the feed direction.

The reading unit 9 scans the front of the document P at reading position A1 in the feed path R when the document is passing reading position A1. Reading position A1 is located between the conveyance roller pairs 20 and 24. The reading unit 9 scans the front of the document P using the charge-coupled device (CCD) system. The reading unit 9 includes platen glass 39, a light source 40, mirrors 42, 44, and 46, a lens 48, and a sensor 50.

The platen glass 39 is provided between the conveyance roller pairs 20 and 24, so as to face the front of the document P being fed by the conveyance roller pairs 20 and 24. The light source 40 is, for example, a fluorescent tube, an LED, or the like, which illuminates the front of the document P passing reading position A1 over the platen glass 39. The mirror 42 redirects light reflected by the document P to the left. The mirror 44 redirects the light from the mirror 42 downward. The mirror 46 redirects the light from the mirror 44 to the right.

The lens 48 collects the light from the mirror 46. The sensor 50 forms an image of the document P from the light collected by the lens 48.

The roller 34 is opposed to the reading unit 9 with respect to the feed path R at reading position A1. The lower part of the roller 34 has a white column-like shape. The upper part of the roller 34 is a brush. The lower part of the roller 34 is used for shading correction when the reading unit 9 scans the front of the document P. The upper part of the roller 34 is used for cleaning the reading unit 9 at reading position A1.

The reading unit 10 scans the back of the document P at reading position A2 in the feed path R when the document is passing reading position A2. Reading position A2 is located between the conveyance roller pairs 24 and 26. The reading unit 10 scans the back of the document P using the contact image sensor (CIS) system.

The roller 36 is opposed to the reading unit 10 with respect to the feed path R at reading position A2. The lower part of the roller 36 has a white column-like shape. The upper part of the roller 36 is a brush. The lower part of the roller 36 is used for shading correction when the reading unit 10 scans the back of the document P. The upper part of the roller 36 is used for cleaning the reading unit 10 at reading position A2.

The ejection roller pair 28 outputs documents P conveyed by the conveyance roller pairs 26, into tray T2. In tray T2, documents P whose images have been scanned are stacked.

Sensor Sen1 is provided between the feed roller pair 14 and the conveyance roller pairs 16, to detect the upstream edge of the document P in the feed direction (this edge will be simply referred to below as edge L2). In the present embodiment, sensor Sen1 is provided to the left of the feed roller pair 14.

Sensor Sen2 is provided between the conveyance roller pairs 16 and the paper stop roller pairs 18, to detect edge L1 of the document P. In the present embodiment, sensor Sen2 is provided to the right of the paper stop roller pairs 18.

The control unit 11 is, for example, a CPU adapted to control the operation of the sheet feeding device 8.

Figure 4B:
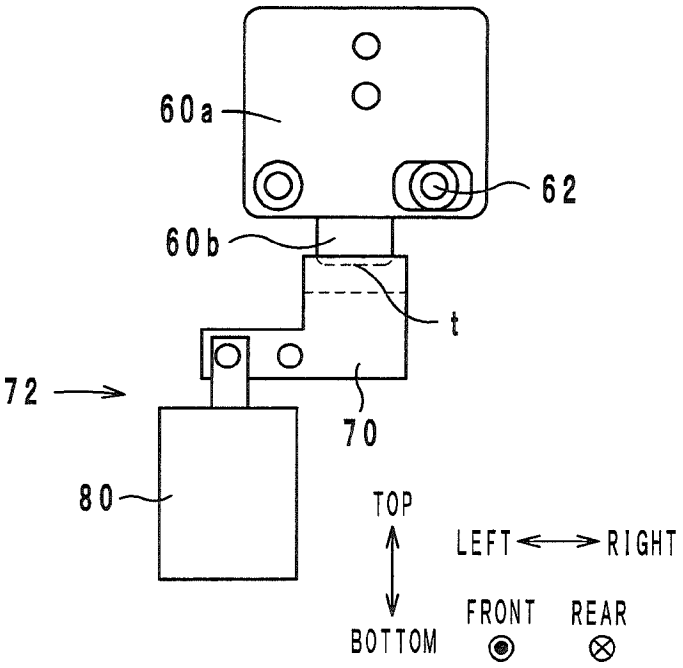
FIGS. 4A and 4B are diagrams illustrating the configuration of the conveyance roller pairs.
Figure 4A:
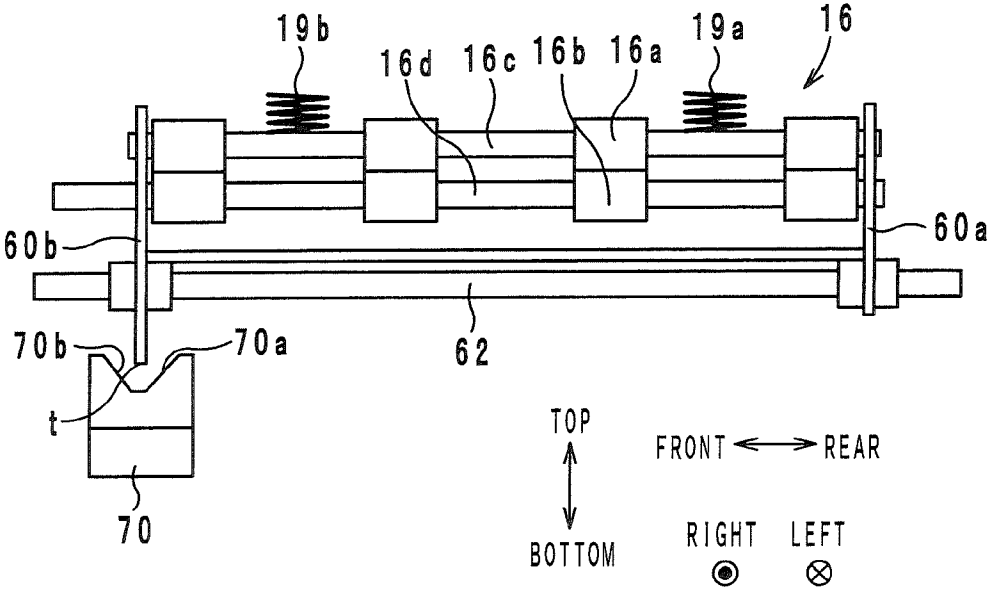

Incidentally, the sheet feeding device 8 has features to perform skew correction on a document P placed lengthwise in the feed direction. The features will be described below with reference to the drawings. FIGS. 4A and 4B are diagrams illustrating the configuration of the conveyance roller pairs 16.

In the sheet feeding device 8, the conveyance roller pairs 16 are adapted to be slidable in a direction perpendicular to the feed direction (i.e., they are slidable in the front-rear direction). Specifically, the conveyance roller pairs 16 include upper rollers 16*a*, lower rollers 16*b*, shafts 16*c* and 16*d*, springs 19*a* and 19*b*, retaining plates 60*a* and 60*b*, and guide rails 62.

The shaft 16*c* is a rod-like member extending in the front-rear direction. The number of upper rollers 16*a* is four, and they are provided on the shaft 16*c* at equal intervals. The shaft 16*d* is a rod-like member provided below the shaft 16*c* so as to extend in the front-rear direction. The number of lower rollers 16*b* is four, and they are provided on the shaft 16*d* at equal intervals so as to contact the upper rollers 16*a* from therebelow. The springs 19*a* and 19*b* press the shaft 16*c* downward so that the upper rollers 16*a* and the lower rollers 16*b* contact each other under pressure. The document P passes between the upper rollers 16*a* and the lower rollers 16*b*.

The retaining plate 60*a* is a plate-like member for supporting the rear ends of the shafts 16*c* and 16*d*. The retaining plate 60*b* is a plate-like member for supporting the front ends of the shafts 16*c* and 16*d*.

The guide rails 62 are rod-like members extending in the front-rear direction and fixed to the body of the sheet feeding device 8. The guide rails 62 penetrate through the retaining plates 60*a* and 60*b* in the front-rear direction. Thus, the upper rollers 16*a*, the lower rollers 16*b*, the shafts 16*c* and 16*d*, the springs 19*a* and 19*b*, and the retaining plates 60*a* and 60*b* can collectively slide in the front-rear direction.

The sheet feeding device 8 further includes a restricting section 72, as shown in FIGS. 4A and 4B. The restricting section 72 includes a restricting member 70 and a driving section 80, to restrict the sliding of the conveyance roller pairs 16. Note that the driving section 80 is omitted in FIG. 4A.

The restricting member 70 is a block with a V-shaped groove extending in the left-right direction, and can move up and down. Moreover, the restricting member 70 is provided below the retaining plate 60*b*, as shown in FIG. 4A. In the following, surfaces of the V-shaped groove will be referred to as surfaces 70*a* and 70*b*. Surface 70*a* is a rear-side surface, and has a normal vector directed toward the upper front. Surface 70*b* is a front-side surface, and has a normal vector directed toward the upper rear.

The driving section 80 is, for example, a solenoid adapted to vertically move the restricting member 70. By the driving section 80 moving the restricting member 70 upward, the bottom edge t of the retaining plate 60*b* contacts the bottom of the V-shaped groove. As a result, the restricting member 70 restricts the sliding of the conveyance roller pairs 16. On the other hand, by the driving section 80 moving the restricting member 70 downward, the bottom edge t of the retaining plate 60*b* is brought out of contact with the bottom of the V-shaped groove, as shown in FIG. 4A. Thus, the restricting member 70 cancels the restriction on the sliding of the conveyance roller pairs 16.

The conveyance roller pairs 16 and the restricting section 72 thus configured operate in the following manners. Specifically, once edge L1 of the document P contacts the paper stop roller pairs 18, as shown in FIG. 3, the restricting section 72 cancels the restriction on the sliding of the conveyance roller pairs 16.

Here, the document P is skewed with the front side of edge L1 positioned downstream from the rear side thereof in the feed direction, as shown in FIG. 3. Accordingly, the front side of edge L1 contacts the paper stop roller pairs 18 ahead of the rear side thereof. Thereafter, the document P is forwarded by the conveyance roller pairs 16, whereby it turns counterclockwise on the front side of edge L1. As a result, the conveyance roller pairs 16 slide in the direction perpendicular to the feed direction, by means of force applied by the document P. Note that the direction in which the conveyance roller pairs 16 slide is the direction from the front side of edge L1 to the rear side thereof (i.e., backward). In this manner, skew correction is performed on the document P. Note that in the case where the document P is skewed with the rear side of edge L1 positioned downstream from the front side thereof in the feed direction, skew correction is performed on the document P by the conveyance roller pairs 16 sliding forward.

Operation of Sheet Feeding Device

Next, the operation of the sheet feeding device 8 will be described with reference to the drawings. FIGS. 5A, 5B, 5C, 5D, 6A, 6B, and 6C are diagrams illustrating the document P being fed through the feed roller pair 14, the conveyance roller pairs 16, and the paper stop roller pairs 18. FIG. 7 is a flowchart showing a process performed by the control unit 11. Note that a document P is fed by the process shown in the flowchart of FIG. 7. To successively feed documents P, the process shown in the flowchart of FIG. 7 is repeated.

Initially, the user sets documents P in tray T1, and operates the touch panel 4 to provide an instruction to start reading a document P. In response, the control unit 11 starts rotating the feed roller pair 14 and the conveyance roller pairs 16 (step S1). The feed roller pair 14 has a higher feed speed than the conveyance roller pairs 16. Accordingly, the topmost of the documents P stacked in tray T1 starts to be fed.

Figure 5A:
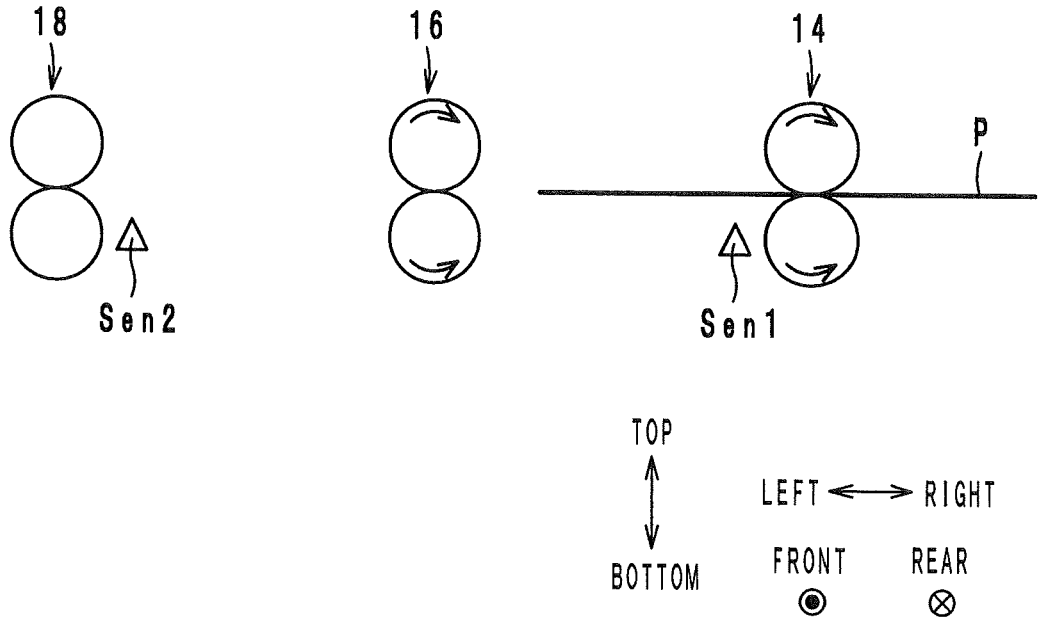
FIGS. 5A, 5B, 5C, and 5D are diagrams illustrating a document being fed through the feed roller pair, the conveyance roller pairs, and the paper stop roller pairs.
Figure 5B:
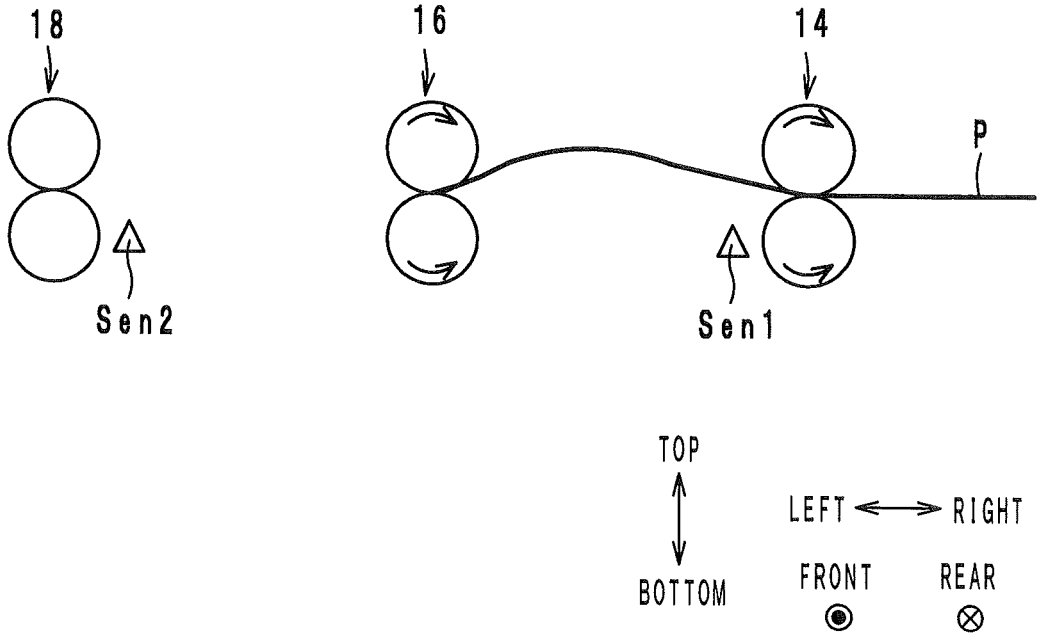
Figure 6A:
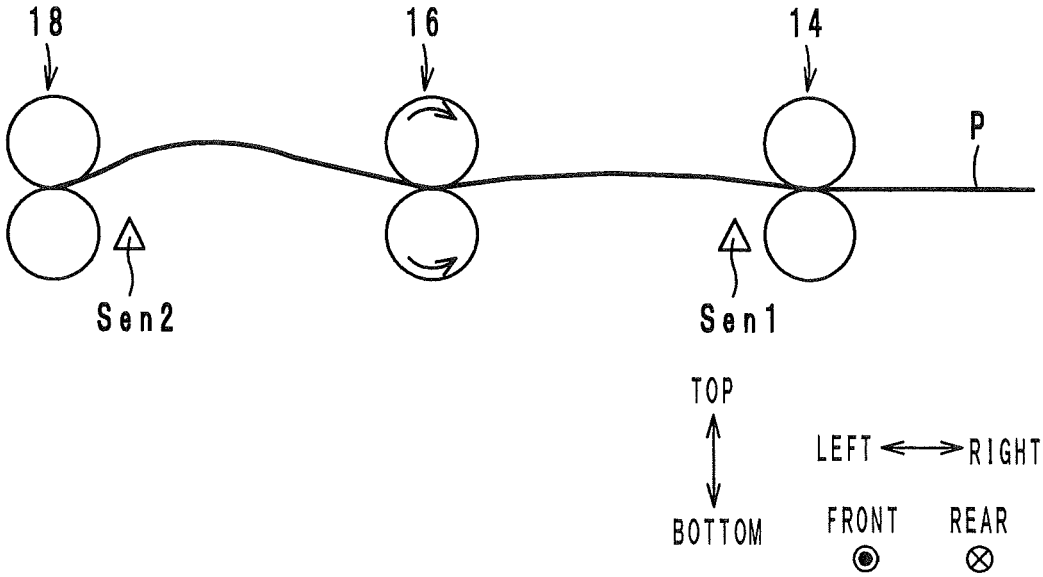
FIGS. 6A, 6B, and 6C are diagrams illustrating a document being fed through the feed roller pair, the conveyance roller pairs, and the paper stop roller pairs.

The document P is fed by the feed roller pair 14, as shown in FIG. 5A. Thereafter, edge L1 of the document P reaches the conveyance roller pairs 16, as shown in FIG. 5B, and then the document P is forwarded by the feed roller pair 14 and the conveyance roller pairs 16. Here, the feed roller pair 14 has a higher feed speed than the conveyance roller pairs 16. Accordingly, the document P slacks between the feed roller pair 14 and the conveyance roller pairs 16.

Figure 5C:
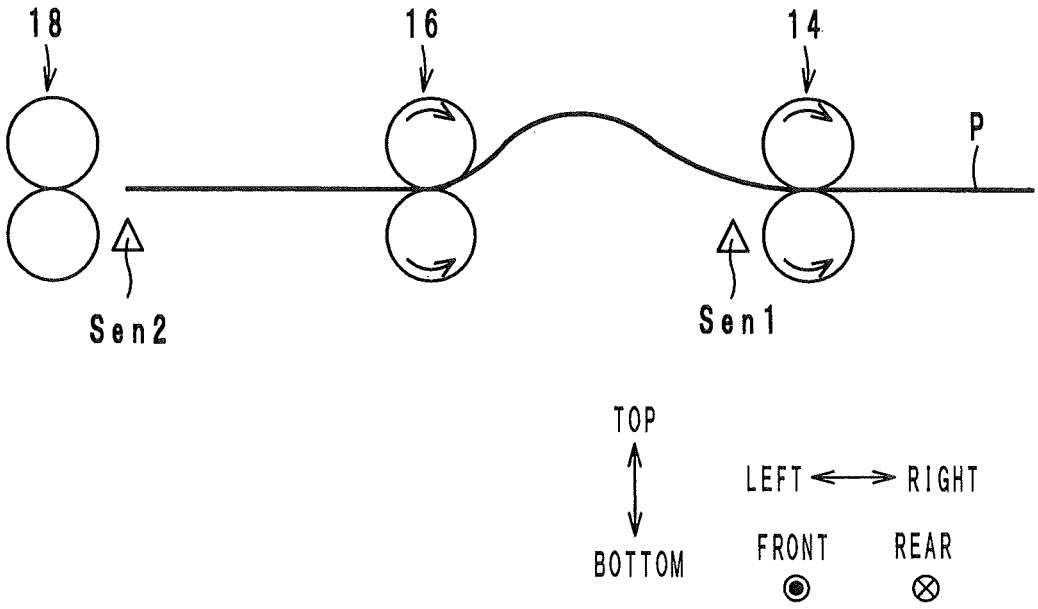

Next, the control unit 11 determines whether or not sensor Sen2 has detected the leading edge (edge L1) of the document P (step S2). Specifically, in step S2, the control unit 11 determines whether or not edge L1 of the document P has reached near the paper stop roller pairs 18 as shown in FIG. 5C. When the leading edge of the document P has already been detected, the process advances to step S3. When the leading edge of the document P has not yet been detected, the process returns to step S2. In this case, step S2 is repeated until the leading edge of the document P is detected.

When the leading edge of the document P has been detected, the control unit 11 stops the feed roller pair 14 (step S3). Specifically, in step S3, when the document P has slacked significantly between the feed roller pair 14 and the conveyance roller pairs 16 as shown in FIG. 5C, the control unit 11 stops the feed roller pair 14 from rotating, in order not to allow the feed roller pair 14 to start feeding the next document P to the one that is being fed. However, the feed roller pair 14 is provided with a one-way clutch which rotates only in the direction in which the document P is to be fed. Therefore, even when the feed roller pair 14 stops rotating, the document P can be forwarded in the feed direction by the conveyance roller pairs 16 and the paper stop roller pairs 18.

Figure 5D:
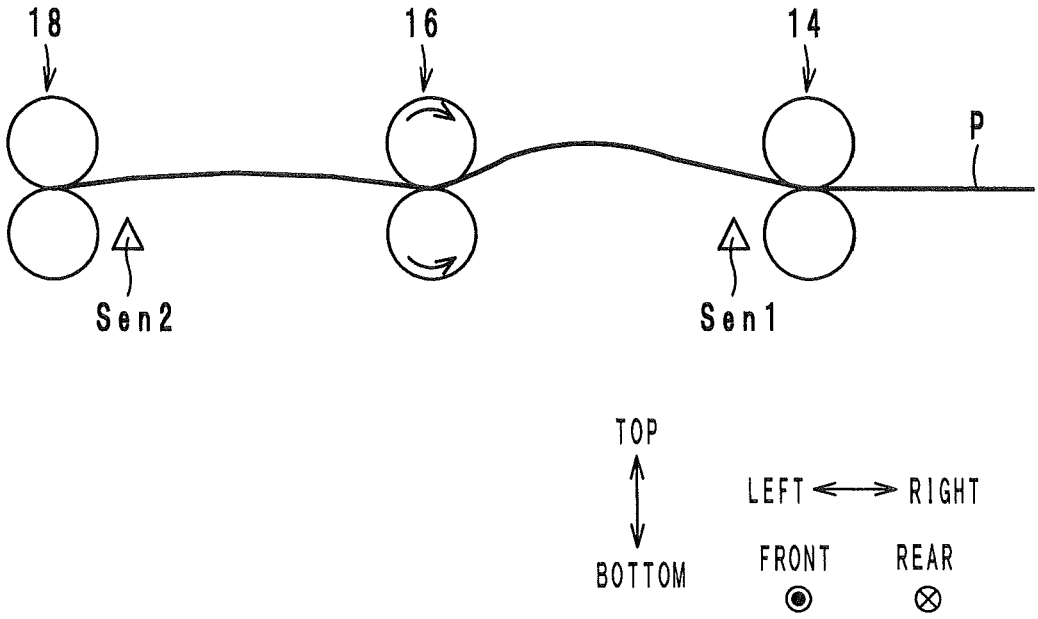

Next, the control unit 11 cancels the restriction by the restricting section 72 on the conveyance roller pairs 16 (step S4). Specifically, the control unit 11 causes the driving section 80 to lower the restricting member 70 such that the restricting member 70 moves away from the retaining plate 60*b* as shown in FIG. 4A. As a result, the conveyance roller pairs 16 can slide in the front-rear direction. The document P is forwarded by the conveyance roller pairs 16, as shown in FIGS. 5D and 6A. Therefore, edge L1 of the document P is pressed against the paper stop roller pairs 18, so that the document P slacks between the conveyance roller pairs 16 and the paper stop roller pairs 18, and the slack gradually increases in size. On the other hand, since the feed roller pair 14 is at rest, the slack in the document P decreases between the feed roller pair 14 and the conveyance roller pairs 16. However, when the conveyance roller pairs 16 start sliding, the size of the slack in the document P is larger between the feed roller pair 14 and the conveyance roller pairs 16 than between the conveyance roller pairs 16 and the paper stop roller pairs 18, as shown in FIG. 5D. Moreover, by edge L1 of the document P being pressed against the paper stop roller pairs 18, the document P is caused to turn, and the conveyance roller pairs 16 slide, whereby skew correction is performed on the document P.

Next, the control unit 11 determines whether or not a given time period has passed after the leading edge of the document P was detected in step S2 (step S5). The given time period is a period of time sufficient for completing skew correction of the document P. Specifically, it is time required for the document P to slack considerably (see FIG. 6B) between the conveyance roller pairs 16 and the paper stop roller pairs 18 after the detection of the leading edge. When the given time period has already passed, the process advances to step S6. On the other hand, when the given time period has not yet passed, the process returns to step S5. In this case, step S5 is repeated until the given time period passes.

Figure 6B:
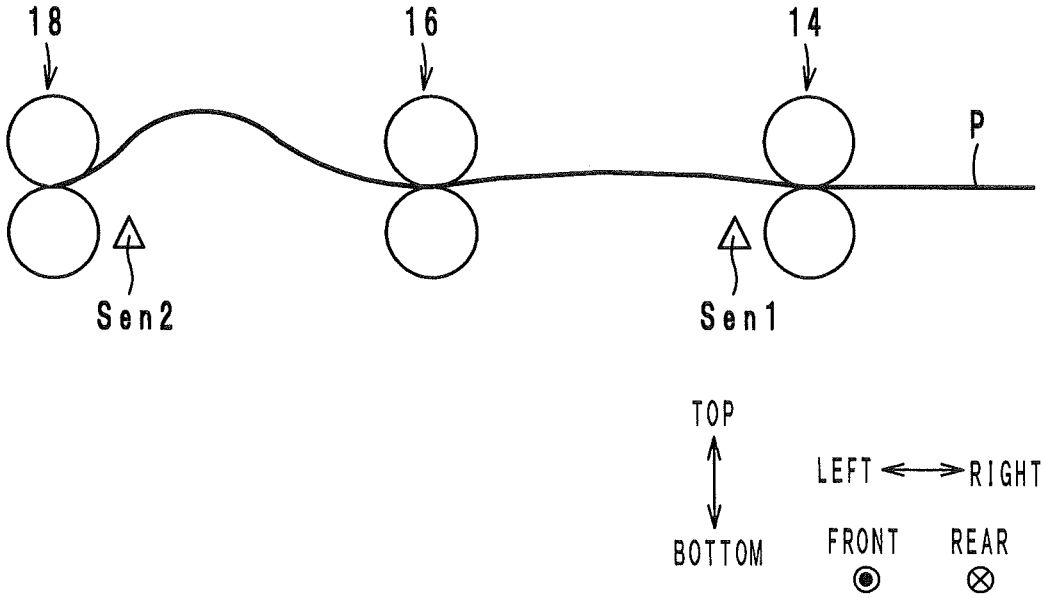
Figure 6C:
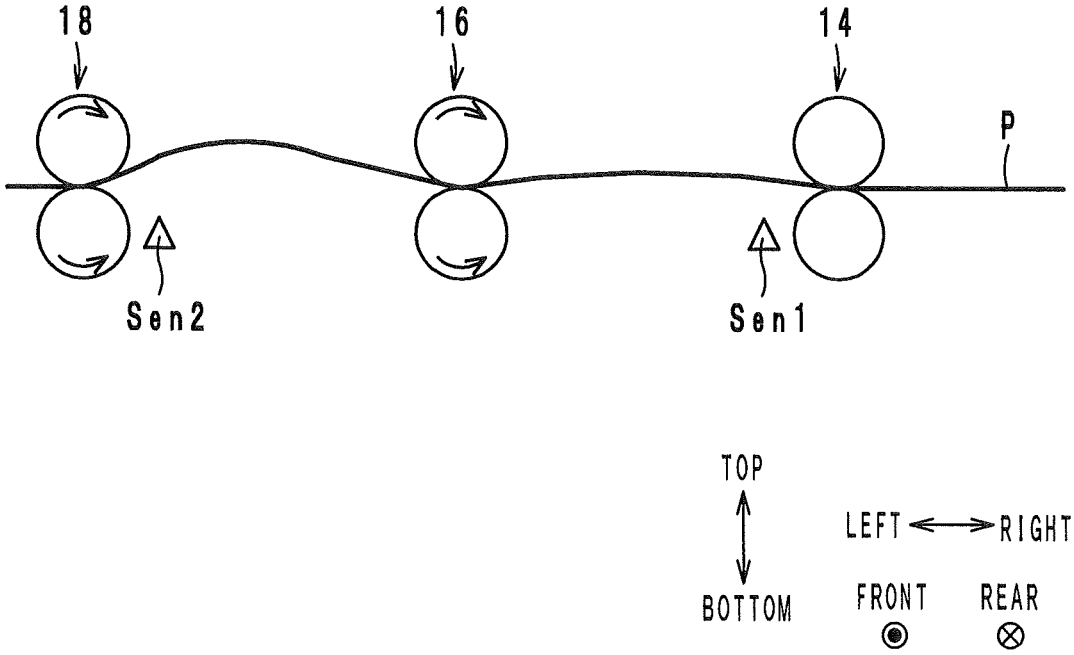
Figure 7:
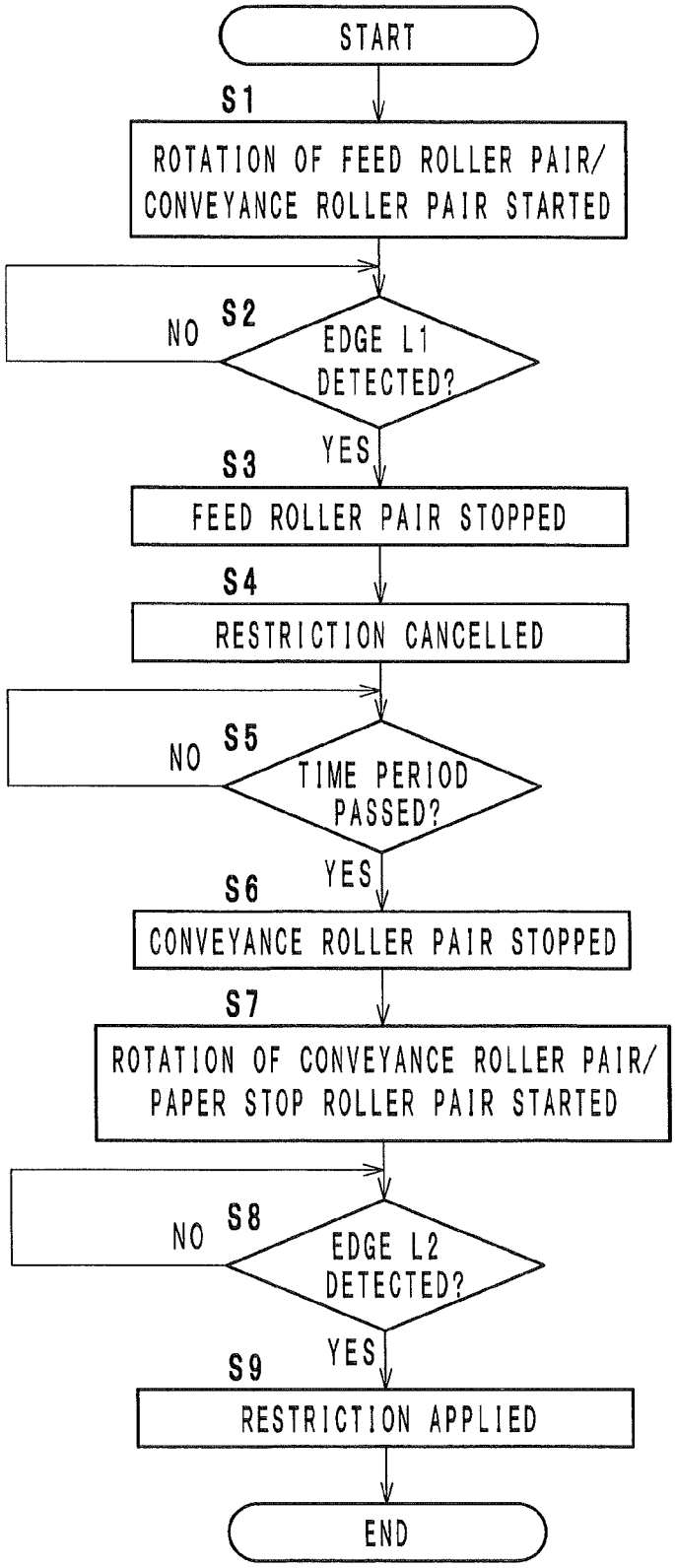
FIG. 7 is a flowchart illustrating a process performed by a control unit.

When the given time period has already passed, the control unit 11 stops the conveyance roller pairs 16 from rotating (step S6), as shown in FIG. 6B. Thereafter, the control unit 11 starts rotating the conveyance roller pairs 16 and the paper stop roller pairs 18 (step S7), as shown in FIG. 6C. As a result, the document P subjected to skew correction is fed.

Next, the control unit 11 determines whether or not sensor Sen2 has detected the trailing edge (edge L2) of the document P (step S8). Specifically, in step S8, the control unit 11 determines whether or not the feeding of the document P has been completed. When the trailing edge of the document P has already been detected, the process advances to step S9. When the trailing edge of the document P has not yet been detected, the process returns to step S8. In this case, step S8 is repeated until the trailing edge of the document P is detected.

When the trailing edge of the document P has already been detected, the control unit 11 causes the restricting section 72 to restrict the sliding of the conveyance roller pairs 16 (step S9). Specifically, the control unit 11 causes the driving section 80 to raise the restricting member 70 such that the restricting member 70 contacts the retaining plate 60*b*. The restricting member 70 has the V-shaped groove, so that, even when the conveyance roller pairs 16 are misaligned in the front-rear direction, the conveyance roller pairs 16 slide in such a manner that the bottom edge t of the retaining plate 60*b* is positioned at the bottom of the groove. As a result, the conveyance roller pairs 16 return to their initial positions. Thus, the process is completed through the above operation.

Effects

The sheet feeding device 8 according to the present embodiment can correct skew of the document P regardless of the size of the document P. More specifically, in the feeding device 500 described in Japanese Patent Laid-Open Publication No. 2003-128297, roller pairs, such as an unillustrated feed roller pair, are provided upstream from the pre-registration roll pair 502 in the feed direction. When a document P is placed lengthwise in the feed direction, the document P is fed by the registration roll pair 504, the pre-registration roll pair 502, and the feed roller pair. In this case, the document P is positioned between the feed roller pair, and therefore the pre-registration roll pair 502 is inhibited from sliding. As a result, the feeding device 500 cannot correct skew of the document P properly.

On the other hand, in the case of the sheet feeding device 8, when edge L1 of the document P, which is located on the downstream side in the feed direction, is skewed in the perpendicular direction (i.e., the front-rear direction), which is perpendicular to the feed direction, the conveyance roller pairs 16 slide in the front-rear direction with the document P slacking between the feed roller pair 14 and the conveyance roller pairs 16. In this manner, when the document P slacks between the feed roller pair 14 and the conveyance roller pairs 16, the conveyance roller pairs 16 can slide even if the document P lies between the feed roller pair 14. Consequently, the sheet feeding device 8 can correct skew of the document P placed lengthwise in the feed direction. Moreover, because the document P slacks, pressure is uniformly applied to the paper stop roller pairs 18, so that the document P is inhibited from being fed in a skewed state. More specifically, in the case where skew correction of the document P was completed after a lapse of a given time period since the leading edge of the document P was detected, when there passes an additional period of time required for the height of a slack loop between the paper stop roller pairs 18 and the conveyance roller pairs 14 to become uniform in the direction perpendicular to the feed direction, the force of the document P pressing the paper stop roller pairs 18 becomes uniform in that perpendicular direction. Thus, when the document P subjected to skew correction is forwarded, the document P is inhibited from being skewed again. Note that the concept of uniformity herein encompasses approximate uniformity.

Furthermore, in the sheet feeding device 8, the feed roller pair 14 has a higher feed speed than the conveyance roller pairs 16. Accordingly, it is possible to cause the document P to slack between the feed roller pair 14 and the conveyance roller pairs 16 without stopping the conveyance roller pairs 16 from rotating. As a result, the sheet feeding device 8 can correct skew of the document P without decreasing the processing speed. However, the control unit 11 may cause the feed roller pair 14 to forward the document P with the conveyance roller pairs 16 at rest, so that edge L1 contacts the conveyance roller pairs 16, thereby causing the document P to slack.

Modification

Figure 8:
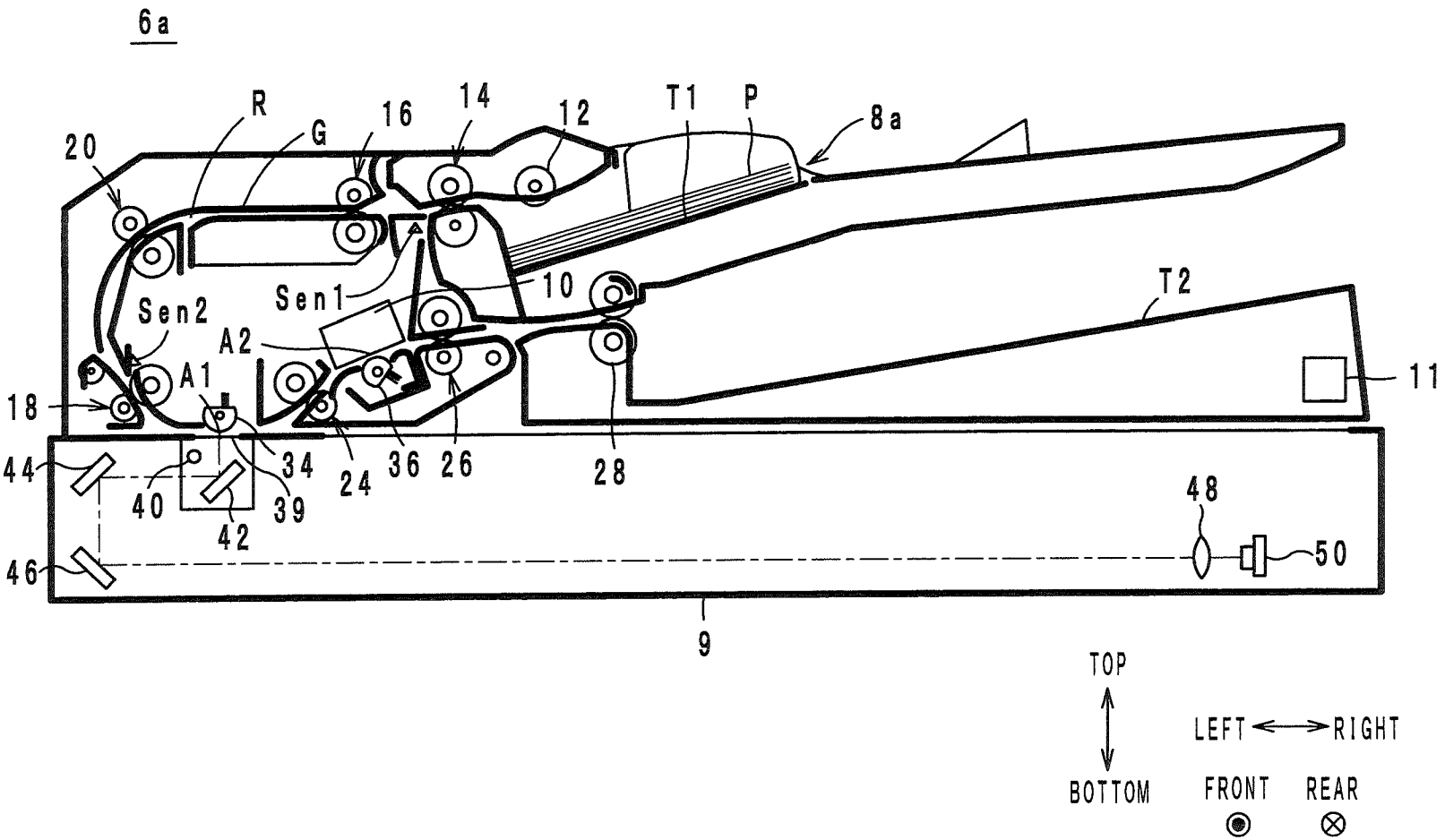
FIG. 8 is a configuration diagram of an image reading apparatus including a sheet feeding device according to a modification.

An image reading apparatus that includes a sheet feeding device according to a modification will be described below. FIG. 8 is a configuration diagram of the image reading apparatus 6*a*, which includes the sheet feeding device 8*a* according to the modification.

The sheet feeding device 8*a* differs from the sheet feeding device 8 in that the paper stop roller pairs 18 and the conveyance roller pairs 20 are switched in position. Accordingly, in the sheet feeding device 8*a*, the paper stop roller pairs 18 are positioned immediately before reading position A1. Therefore, there is no roller pair between the paper stop roller pairs 18 and reading position A1. As a result, the document P subjected to skew correction is scanned at reading position A1. Thus, any image scanned by the image reading apparatus 6*a* has improved quality.

Second Embodiment

Figure 9:
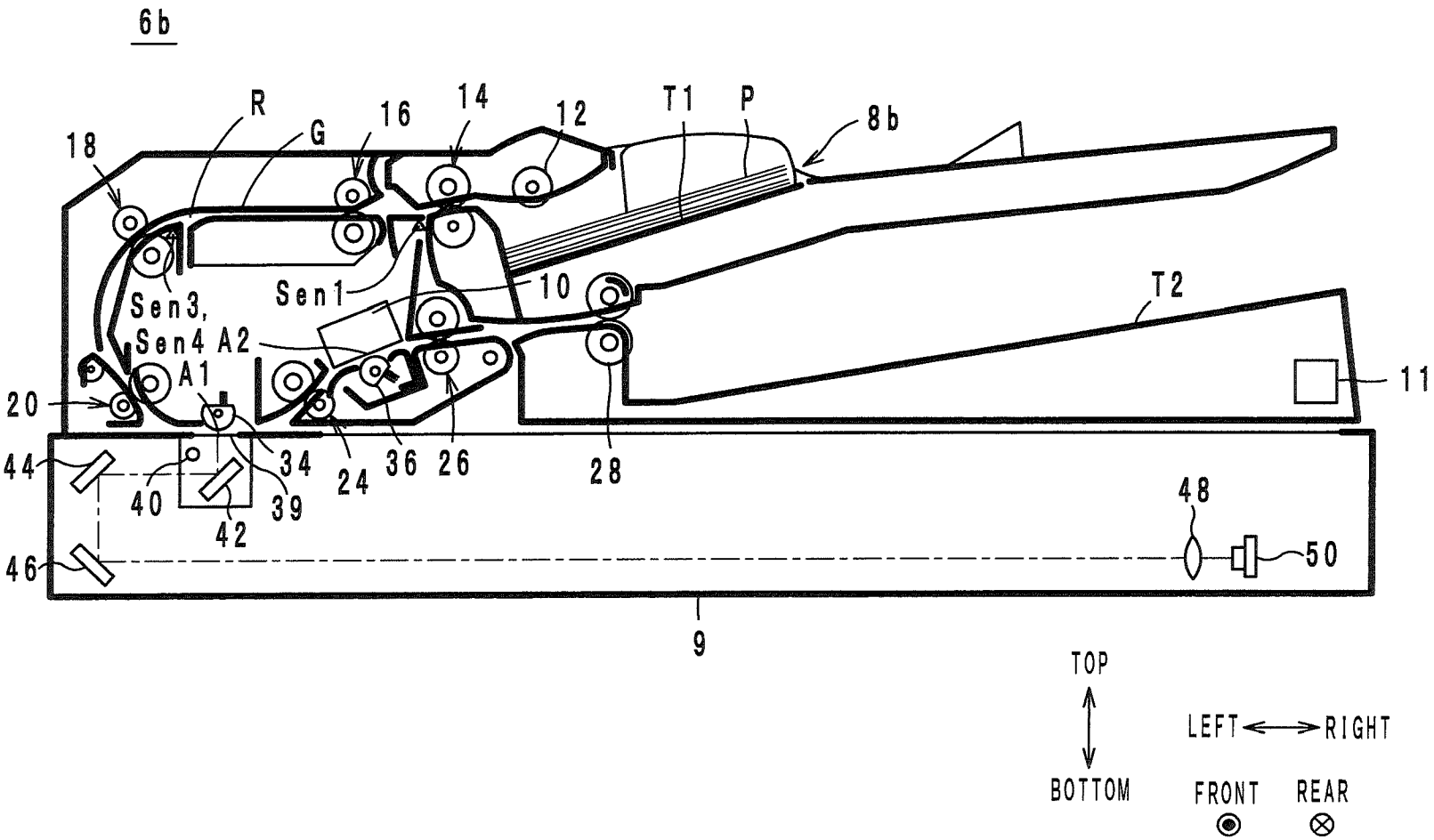
FIG. 9 is a configuration diagram of an image reading apparatus including a sheet feeding device according to a second embodiment.
Figure 10:
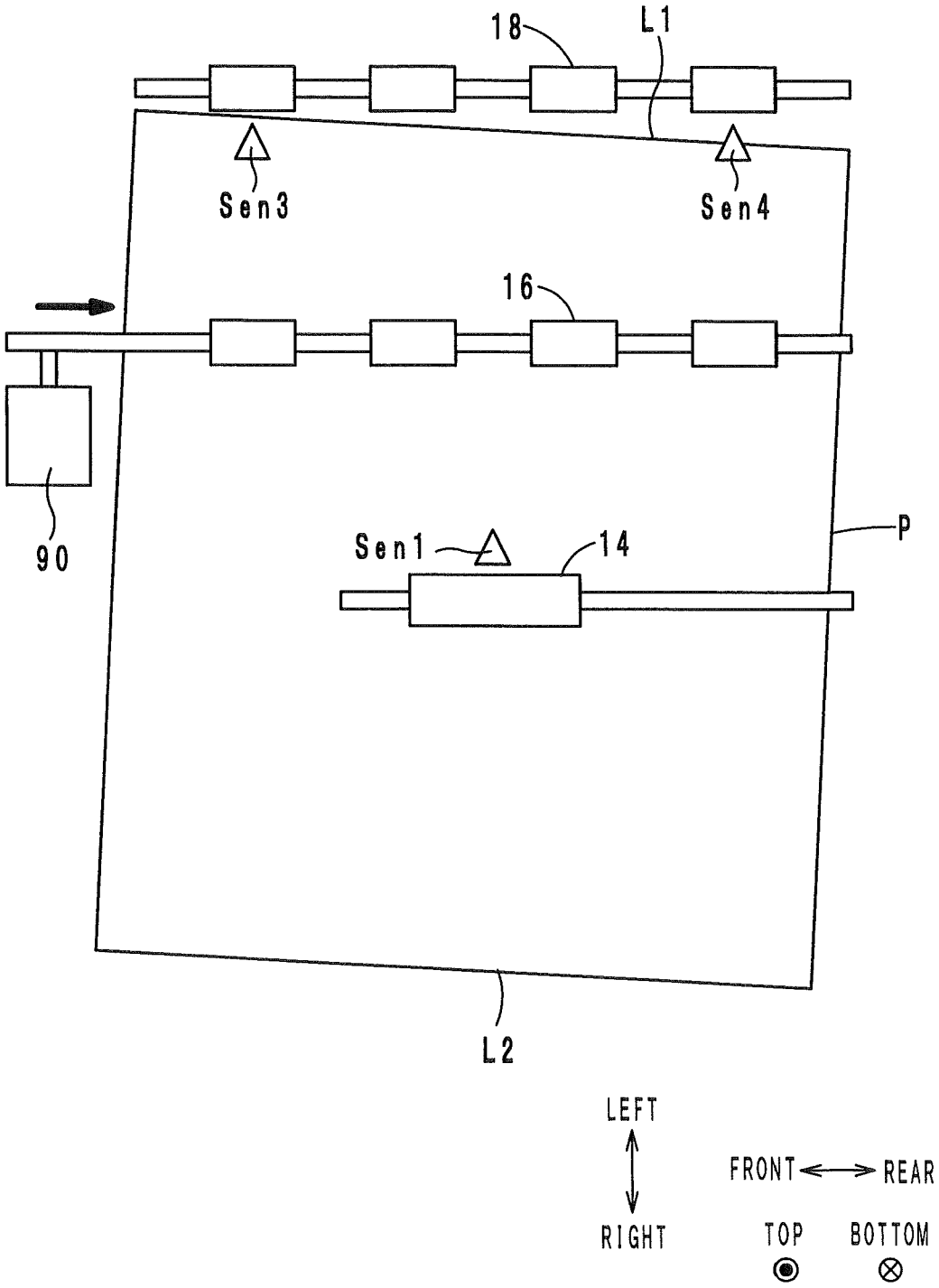
FIG. 10 is a top view of a feed roller pair, conveyance roller pairs, and paper stop roller pairs in the image reading apparatus.

Hereinafter, the configuration of a sheet feeding device according to a second embodiment of the present invention will be described with reference to the drawings. FIG. 9 is a configuration diagram of an image reading apparatus 6*b* that includes the sheet feeding device 8*b* according to the second embodiment. FIG. 10 is a top view of a feed roller pair 14, conveyance roller pairs 16, and paper stop roller pairs 18 in the image reading apparatus 6*b*.

The sheet feeding device 8*b* differs from the sheet feeding device 8 in that it includes a driving section 90 in place of the restricting section 72, and sensors Sen3 and Sen4 in place of sensor Sen2, as shown in FIGS. 9 and 10. The sheet feeding device 8*b* will be described below focusing on these differences.

The driving section 90 is made up of, for example, a combination of a motor and gears (e.g., a rack gear and a pinion gear) adapted to slide the conveyance roller pairs 16 in the front-rear direction. Sensors Sen3 and Sen4 are provided between the conveyance roller pairs 16 and the paper stop roller pairs 18, to detect skew of edge L1 of the document P. More specifically, sensor Sen3 is positioned to the right of the front-side paper stop roller pair 18. Sensor Sen4 is positioned to the right of the rear-side paper stop roller pair 18. As such, sensors Sen3 and Sen4 are arranged in the front-rear direction.

The control unit 11 causes the driving section 90 to drive the conveyance roller pairs 16 on the basis of a skewing direction detected by sensors Sen3 and Sen4. Specifically, when sensor Sen3 detects edge L1 ahead of sensor Sen4, the control unit 11 determines that the document P is skewed with the front side of edge L1 positioned downstream from the rear side thereof in the feed direction. In this case, the control unit 11 causes the driving section 90 to operate in such a manner that the conveyance roller pairs 16 slide backward. When sensor Sen4 detects edge L1 ahead of sensor Sen3, the control unit 11 determines that the document P is skewed with the rear side of edge L1 positioned downstream from the front side thereof in the feed direction. In this case, the control unit 11 causes the driving section 90 to operate in such a manner that the conveyance roller pairs 16 slide forward.

Figure 11:
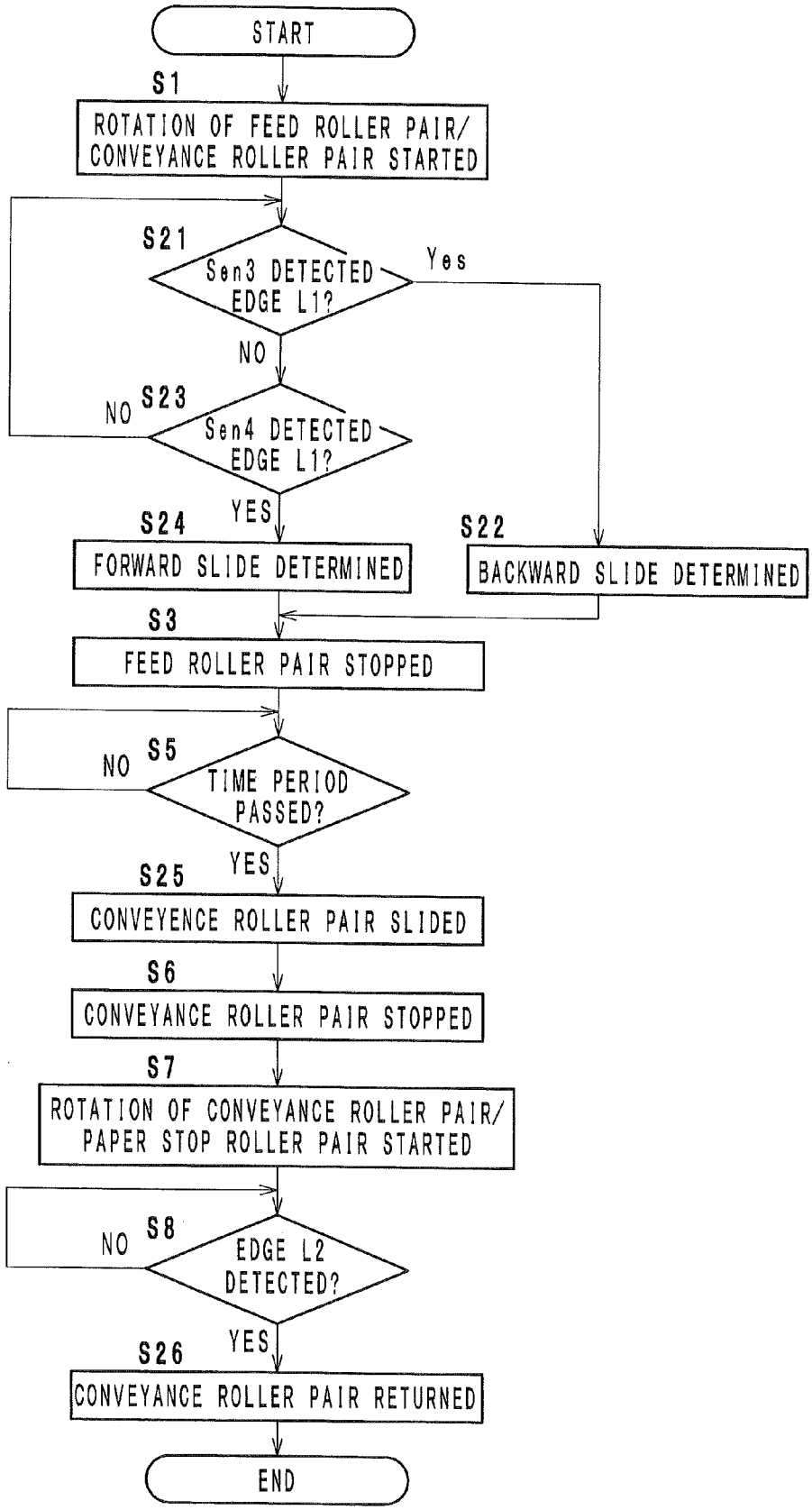
FIG. 11 is a flowchart illustrating a process performed by a control unit.
Figure 12A:
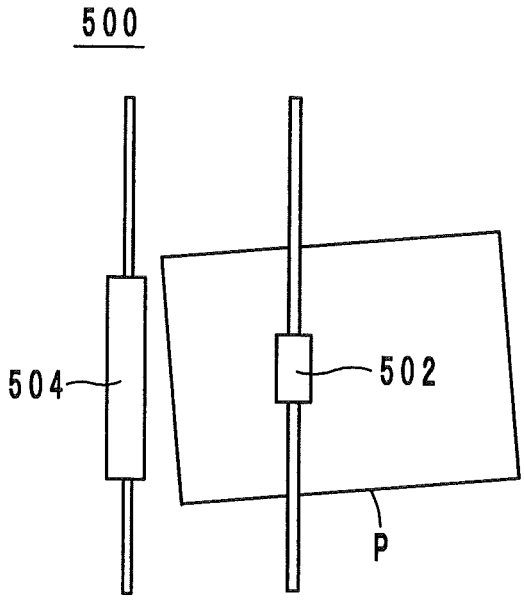
FIGS. 12A and 12B are top views of a feeding device described in Japanese Patent Laid-Open Publication No. 2003-128297.
Figure 12B:
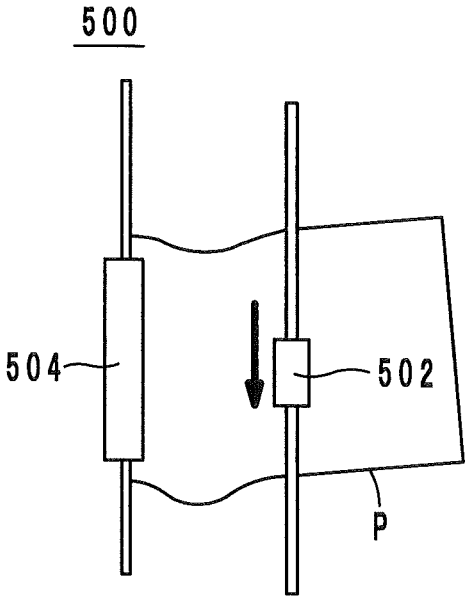

Next, the operation of the sheet feeding device 8*b* will be described with reference to the drawings. FIG. 11 is a flowchart illustrating a process performed by the control unit 11. Note that a document P is fed by the process shown in the flowchart of FIG. 11. To successively feed documents P, the process shown in the flowchart of FIG. 11 is repeated.

Step S1 of FIG. 11 performed by the sheet feeding device 8*b* is the same as step S1 of FIG. 7 performed by the sheet feeding device 8, and therefore any description thereof will be omitted.

Next, the control unit 11 determines whether or not sensor Sen3 has detected the leading edge (edge L1) of the document P (step S21). When the leading edge of the document P has been detected, the process advances to step S22. When the leading edge of the document P has not been detected, the process advances to step S23.

When the leading edge of the document P has been detected, the control unit 11 determines that the document P is skewed with the front side of edge L1 positioned downstream from the rear side thereof in the feed direction. Therefore, the control unit 11 decides that the conveyance roller pairs 16 should slide backward (step S22). Thereafter, the process advances to step S3.

When the leading edge (edge L1) of the document P has not been detected by sensor Sen3, the control unit 11 determines whether or not sensor Sen4 has detected the leading edge of the document P (step S23). When the leading edge of the document P has been detected by sensor Sen4, the process advances to step S24. When the leading edge of the document P has not been detected, the process returns to step S21. In this case, steps S21 and S23 are repeated until sensor Sen3 or Sen4 detects the leading edge of the document P.

When the leading edge of the document P has been detected by sensor Sen4, the control unit 11 determines that the document P is skewed with the rear side of edge L1 positioned downstream from the front side thereof in the feed direction. Therefore, the control unit 11 decides that the conveyance roller pairs 16 should slide forward (step S24). Thereafter, the process advances to step S3.

Steps S3 and S5 of FIG. 11 performed by the sheet feeding device 8*b* are the same as steps S3 and S5 of FIG. 7 performed by the sheet feeding device 8, and therefore any descriptions thereof will be omitted.

Next, the control unit 11 causes the driving section 90 to slide the conveyance roller pairs 16 in the direction decided in step S22 or S24 (step S25). Thus, the skew of the document P is corrected.

Steps S6 to S8 of FIG. 11 performed by the sheet feeding device 8*b* are the same as steps S6 to S8 of FIG. 7 performed by the sheet feeding device 8, and therefore any descriptions thereof will be omitted.

Next, the control unit 11 causes the driving section 90 to return the conveyance roller pairs 16 to their initial positions (step S26). The process is completed through the above operation.

Effects

As with the sheet feeding device 8, the sheet feeding device 8*b* according to the present embodiment can correct skew of the document P regardless of the size of the document P. Moreover, as with the sheet feeding device 8, the sheet feeding device 8*b* can correct skew of the document P without decreasing the processing speed.

Other Embodiments

The present invention is not limited to the sheet feeding devices 8, 8*a*, and 8*b* according to the above embodiments, and changes can be made without departing from the spirit and scope of the invention.

While the control unit 11 has been described as being provided in each of the sheet feeding devices 8, 8*a*, and 8*b*, the control unit 11 may be provided in the image forming apparatus 1 but outside the sheet feeding device 8, 8*a*, or 8*b*.

Furthermore, the control unit 11 may control the feed speed of the feed roller pair 14 and the feed speed of the conveyance roller pairs 16, such that the slack of the document P between the feed roller pair 14 and the conveyance roller pairs 16 decreases in size as the grammage of the document P increases.

Furthermore, when the dimension of the document P in the feed direction is shorter than the distance between the feed roller pair 14 and the paper stop roller pairs 18, the control unit 11 controls the feed speed of the feed roller pair 14 and the feed speed of the paper stop roller pairs 18 such that the document P does not slack between the feed roller pair 14 and the paper stop roller pairs 18.

Furthermore, when different sizes of documents P are stacked in tray T1, the control unit 11 controls the feed speed of the feed roller pair 14 and the feed speed of the paper stop roller pairs 18 such that the documents P slack between the feed roller pair 14 and the paper stop roller pairs 18.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sheet feeding device comprising:

a first conveyance roller pair that feeds a sheet;

a second conveyance roller pair that feeds the sheet, the second conveyance roller pair being provided downstream from the first conveyance roller pair in a feed direction in which the sheet is fed;

a third conveyance roller pair that feeds the sheet, the third conveyance roller pair being provided downstream from the second conveyance roller pair in the feed direction; and a first detecting section that detects an edge of the sheet that is located on the downstream side of the feed direction, wherein in a case when the edge of the sheet is skewed with respect to a direction perpendicular to the feed direction, after the first detecting section detects that the edge of the sheet contacts the third conveyance roller pair, a control section controls the second conveyance roller pair to slide in the perpendicular direction with the sheet slacking between the first conveyance roller pair and the second conveyance roller pair.

2. The sheet feeding device according to claim 1, wherein the first conveyance roller pair has a higher feed speed than the second conveyance roller pair.

3. The sheet feeding device according to claim 1, wherein, when a first side of the downstream edge of the sheet is positioned downstream from a second side of the downstream edge in the feed direction, the second conveyance roller pair slides in the perpendicular direction from the first side toward the second side.

4. The sheet feeding device according to claim 1, wherein the second conveyance roller pair slides in the perpendicular direction by means of force applied by the sheet.

5. The sheet feeding device according to claim 1, further comprising:

a driving section that slides the second conveyance roller pair;

the first detecting section that detects a skewing direction of the downstream edge; and the control section causes the driving section to slide the second conveyance roller pair on the basis of the direction detected by the first detecting section.

6. The sheet feeding device according to claim 1, wherein, when the second conveyance roller pair starts sliding, the sheet has a slack between the second conveyance roller pair and the third conveyance roller pair.

7. The sheet feeding device according to claim 6, wherein, when the second conveyance roller pair starts sliding, the slack of the sheet between the first conveyance roller pair and the second conveyance roller pair is larger than the slack of the sheet between the second conveyance roller pair and the third conveyance roller pair.

8. The sheet feeding device according to claim 1, wherein the slack of the sheet between the first conveyance roller pair and the second conveyance roller pair decreases in size as the grammage of the sheet increases.

9. A sheet feeding device comprising:

a first conveyance roller pair that feeds a sheet;

a second conveyance roller pair that feeds the sheet, the second conveyance roller pair being provided downstream from the first conveyance roller pair in a feed direction in which the sheet is fed; and a third conveyance roller pair that feeds the sheet, the third conveyance roller pair being provided downstream from the second conveyance roller pair in the feed direction, wherein when an edge of the sheet that is located on the downstream side of the feed direction is skewed with respect to a direction perpendicular to the feed direction, and contacts the third conveyance roller pair, the second conveyance roller pair slides in the perpendicular direction with the sheet slacking between the first conveyance roller pair and the second conveyance roller pair, and the second conveyance roller pair slides in the perpendicular direction by means of force applied by the sheet, and the sheet feeding device further comprising a restricting section that restricts sliding of the second conveyance roller pair, wherein when a first detecting section detects that the downstream edge contacts the third conveyance roller pair, the restriction by the restricting section on the second conveyance roller pair is cancelled by a control section.

10. The sheet feeding device according to claim 9, further comprising:

the first detecting section provided between the second conveyance roller pair and the third conveyance roller pair; and the control section that cancels the restriction by the restricting section on the second conveyance roller pair when the first detecting section detects the downstream edge.

11. The sheet feeding device according to claim 10, wherein the control section causes the first conveyance roller pair to feed the sheet with the second conveyance roller pair at rest, such that the downstream edge contacts the second conveyance roller pair, thereby slackening the sheet.

12. The sheet feeding device according to claim 10, wherein, the control section stops the first conveyance roller pair once the sheet slacks between the first conveyance roller pair and the second conveyance roller pair, and the first conveyance roller pair is provided with a one-way clutch that rotates only in a direction of feeding the sheet.

13. An image processing apparatus comprising:

a sheet feeding device; and a control section, wherein, the sheet feeding device includes:

a first conveyance roller pair that feeds a sheet;

a second conveyance roller pair that feeds the sheet, the second conveyance roller pair being provided downstream from the first conveyance roller pair in a feed direction in which the sheet is fed; and a third conveyance roller pair that feeds the sheet, the third conveyance roller pair being provided downstream from the second conveyance roller pair in the feed direction, when an edge of the sheet that is located on the downstream side of the feed direction is skewed with respect to a direction perpendicular to the feed direction, the second conveyance roller pair slides in the perpendicular direction with the sheet slacking between the first conveyance roller pair and the second conveyance roller pair, the second conveyance roller pair slides in the perpendicular direction by means of force applied by the sheet, the sheet feeding device further includes a restricting section that restricts sliding of the second conveyance roller pair, when the downstream edge contacts the third conveyance roller pair, the restriction by the restricting section on the second conveyance roller pair is cancelled, the sheet feeding device further includes a first detecting section provided between the second conveyance roller pair and the third conveyance roller pair, and the control section cancels the restriction by the restricting section on the second conveyance roller pair once the first detecting section detects the downstream edge.

14. An image processing apparatus comprising:

a sheet feeding device; and a control section, wherein, the sheet feeding device includes:

a first conveyance roller pair that feeds a sheet;

a second conveyance roller pair that feeds the sheet, the second conveyance roller pair being provided downstream from the first conveyance roller pair in a feed direction in which the sheet is fed;

a third conveyance roller pair that feeds the sheet, the third conveyance roller pair being provided downstream from the second conveyance roller pair in the feed direction; and a first detecting section that detects an edge of the sheet that is located on the downstream side of the feed direction, wherein in a case when the first detecting section detects that the edge of the sheet is skewed with respect to a direction perpendicular to the feed direction, after the edge of the sheet contacts the third conveyance roller pair, the second conveyance roller pair slides in the perpendicular direction with the sheet slacking between the first conveyance roller pair and the second conveyance roller pair, the sheet feeding device further includes:

a driving section that slides the second conveyance roller pair, and the control section causes the driving section to slide the second conveyance roller pair on the basis of the direction detected by the first detecting section.

* * * * *